United States Patent [19]

Fujikawa et al.

[11] 4,328,769

[45] May 11, 1982

[54] COOLING SYSTEM OF LIQUID-COOLED MULTICYLINDER ENGINE

[75] Inventors: Tetsuzo Fujikawa, Kobe; Toshiyuki Takada, Miki; Shinichi Tamba, Kakogama, all of Hyogo, Japan

[73] Assignee: Kawasaki Jukogyo Kabushiki Kaisha, Kobe, Japan

[21] Appl. No.: 241,304

[22] Filed: Mar. 6, 1981

Related U.S. Application Data

[63] Continuation of Ser. No. 970,503, Dec. 18, 1978, abandoned.

[30] Foreign Application Priority Data

Dec. 26, 1977 [JP] Japan ..... 52-179440[U]

[51] Int. Cl.³ ..... F01P 5/10

[52] U.S. Cl. ..... 123/41.47; 123/198 C

[58] Field of Search ..... 123/41.44, 41.45, 41.74, 123/41.28, 198 C; 417/364; 180/229

[56] References Cited

U.S. PATENT DOCUMENTS

| | | | |
|---|---|---|---|
| 1,042,888 | 10/1912 | Butsch | 123/41.44 |
| 1,201,731 | 10/1916 | Hinkley | 123/41.47 |
| 1,537,805 | 5/1925 | Davidson | 123/59 B X |
| 1,840,010 | 1/1932 | Balough | 123/41.47 |
| 1,909,926 | 5/1933 | Balough | 123/41.74 |
| 2,725,866 | 12/1955 | Scheiterlein | 123/195 A |
| 3,059,624 | 10/1962 | Torre | 123/59 B |
| 3,926,157 | 12/1975 | Lippitsch | 123/41.47 |
| 4,190,023 | 2/1980 | Fujikawa et al. | 123/41.74 |

*Primary Examiner*—William A. Cuchlinski, Jr.

*Attorney, Agent, or Firm*—Jordan and Hamburg

[57] ABSTRACT

A cooling system of a liquid-cooled multicylinder engine of the two cycle type, wherein a crank shaft is journalled by bearings housed in bearing housings of a small diameter mounting therein airtight seal members as well as the bearings and located at opposite end portions and an intermediate portion of a crank case consisting of upper and lower members, cylinders are arranged on the upper end surface of the upper crank case member, and each cylinder has a suction conduit attached to one side thereof and an exhaust conduit attached to the other side thereof, includes a centrifugal pump driven by the crank shaft for circulating a cooling liquid and located in a recess on the suction side of the crank case between cylinders, with the axis of the pump being parallel to the crank shaft. The centrifugal pump is formed at its lower end portion with a pump outlet extending substantially horizontally and connected to a suction side inlet of a liquid passage extending along the underside and the exhaust side of the bearing housing in the intermediate portion of the crank case, and a liquid jacket communicating with the liquid passage is mounted on the entire exhaust side portion of the upper crank case member and has an upper outlet connected to another liquid jacket in each of the cylinders at the interface between the crank case and the cylinders.

6 Claims, 3 Drawing Figures

COOLING SYSTEM OF LIQUID-COOLED MULTICYLINDER ENGINE

This is a continuation, of application Ser. No. 970,503, filed Dec. 18, 1978 now abandoned.

BACKGROUND OF THE INVENTION

This invention relates to a cooling system of a liquid-cooled multicylinder engine, particularly a liquid-cooled multicylinder engine of the two cycle type, the cooling system being suitable for use with an engine in which a liquid pump cannot easily be secured to one end of a crank shaft, such as a snow mobile engine having secured to opposite ends of the crank shaft a flywheel of the alternating current ignition system and a belt converter.

The construction and disadvantages of cooling systems of engines of the prior art can be summarized as follows:

1. In one type of cooling system of a liquid-cooled multicylinder engine known in the art, proposals have been made to arrange a liquid pump on one side of the crank case. When the liquid pump is mounted in this position, the pump protrudes sideways from the crank case and increases the bulk of the engine.

2. A cooling system wherein a liquid pump driven by an end of a crank shaft is secured to one end of a crank case and the outlet of the pump is connected directly to the inlet of a liquid passage in the double wall of the crank case which liquid passage has an outlet connected to a liquid jacket in the cylinder at the interface between the crank case and the cylinder and beneath an exhaust conduit has been proposed for use with a liquid-cooled monocylinder engine of the two cycle type. The cooling system of the aforesaid construction offers the advantages that the exhaust conduit and its vicinity are cooled satisfactorily and liquid conduits can be dispensed with. However, since the liquid pump is secured to one end of the crank case, this type of cooling system cannot be applied to a snow mobile engine, for example, which has a flywheel of the alternating current ignition system secured to one end of the crank shaft and a belt converter secured to the other end thereof and in which it is consequently difficult to secure a liquid pump to one end of the crank case. Difficulty also exists in securing a liquid pump to one end of the crank case of an engine of a two-wheeled motorcycle suction system, because parts concerned with suction are mounted at opposite ends of the crank case. Furthermore, in the aforesaid conventional system, a cooling liquid delivered by a liquid pump first flows through a liquid passage in the double wall of the crank case axially of the crank shaft, and then changes its direction of flow upwardly immediately below the suction conduit. In a cooling system having a cooling liquid passage of this construction, the difficulty in uniformly cooling the exhaust conduit and its vicinity increases with each increase in the number of cylinders.

3. In engines of the prior art having more than two cylinders, the wall of the crank case located between the cylinders is constructed to form a housing for bearings journalling the crank shaft. The portion of the wall of the crank case constituting the bearing housing is subjected to heat transmitted from the cylinders, and its temperature rises to a considerably high level (about 150° C.) due partly to the fact that it is difficult to efficiently cool this portion. Thus difficulty is encountered in selecting material, such as rubber for use as an oil seal to be mounted within the bearing housing as an airtight seal member for the crank chambers, and expensive rubber must be used for this purpose.

4. In conventional multicylinder engines of the two cycle type, a crank case formed of a light alloy material is composed of two members, upper and lower. In an engine of this type there is a tendency to produce gaps between the bearing housing and the bearings due to the difference in thermal expansion of the crank case wall, formed of a light metal alloy, and the bearings, caused by a marked rise in temperature in the wall of the crank case which constitutes the bearing housing. When this is the case, a creep is produced in the bearings. In a crank case formed of a light alloy in two parts, it is difficult to provide a large interference between the crank case and the bearings as a measure to prevent this phenomenon. More specifically, if a large interference is provided, the crank case will have an inordinately large thickness and weight, thereby raising the problem of high cost. Additionally, if a large interference is provided, radial gaps between the bearings must be increased, raising the problems of vibration of the crank shaft and noise production by the bearings when the temperature in the crank case becomes high. There have been, for example, cases in which a knock pin is attached to the outer race of the bearing or a weblike ring of nylon is inserted in the outer race of the bearing to cope with the production of a creep. The use of a knock pin has disadantages, however, in that the number of steps in producing the bearings is increased, difficulty is created in assembling the bearing and cost of the bearing increases. There is, moreover, little of benefit to offset all these disadvantages. The insertion of the web-like nylon in the bearing outer race results in reduced strength of the outer race due to the presence of a cutout formed therein for providing a groove for receiving the nylon member, as well as increasing the cost of the bearing.

SUMMARY OF THE INVENTION

One object of this invention is to provide a cooling system of a liquid-cooled multicylinder engine including a liquid pump arranged on one side of the crank case of the engine without increasing the bulk of the engine as a whole, unlike a liquid-cooled multicylinder engine of the prior art.

Another object is to provide a cooling system of a liquid-cooled multicylinder engine of the two cycle type having the construction of a conventional cooling system of a monocylinder engine which has been rendered applicable to a liquid-cooled multicylinder engine of the two cycle type in which a liquid pump cannot easily be secured to one end of its crank shaft, such cooling system being constructed so that the liquid pump is directly connected at its outlet to an inlet of a liquid passage in the double wall of a crank case which in turn is connected at its outlet to a liquid jacket in each of the cylinders at the interface between the crank case and the cylinders and beneath exhaust conduits. The cooling system of this construction offers the advantage that it is capable of not only increasing the efficiency of cooling the exhaust conduits and their vicinity beyond that of conventional cooling systems but of uniformly cooling the exhaust conduits and their vicinity as well.

Still another object is to provide a cooling system of a liquid-cooled multicylinder engine of the two cycle type which is capable of increasing the efficiency of cooling at least one bearing in a bearing housing located between the crank chambers of the engine for journalling a crank shaft, and which is capable of cooling an airtight seal member when such member is arranged in the bearing housing.

A further object is to provide a cooling system of a liquid-cooled multicylinder engine of the two cycle type which is capable of efficiently cooling the bearing housing, with the result that the disadvantage of the prior art which is encountered when the crank case is composed of two members, upper and lower can be eliminated.

According to the present invention, a liquid pump of the cooling system is arranged in a recess on the suction side of the crank case adjacent the bearing housing, so as to reduce the section of the pump which projects sideways, such arrangement being made on the basis of the discovery that the portion of the crank case constituting the bearing housing disposed between the crank chambers in the crank case and associated with the respective cylinders is smaller in diameter than other portions of the crank case at opposite end portions thereof. The cooling system further includes a liquid passage connected to the liquid pump and extending along the underside and the exhaust side of the bearing housing in a manner to encircle the same by utilizing the aforesaid recess in the portion of the crank case constituting the bearing housing so as to positively cool the bearing housing interposed between the crank chamber. There is also included a liquid jacket extending along the exhaust side and the entire upper half portion of an upper crank case member and communicating with an upper end of the liquid passage so as to effectively cut off the transfer of heat from exhaust conduits to the bearing housing.

DESCRIPTION OF THE PREFERRED EMBODIMENT

Figure 1:
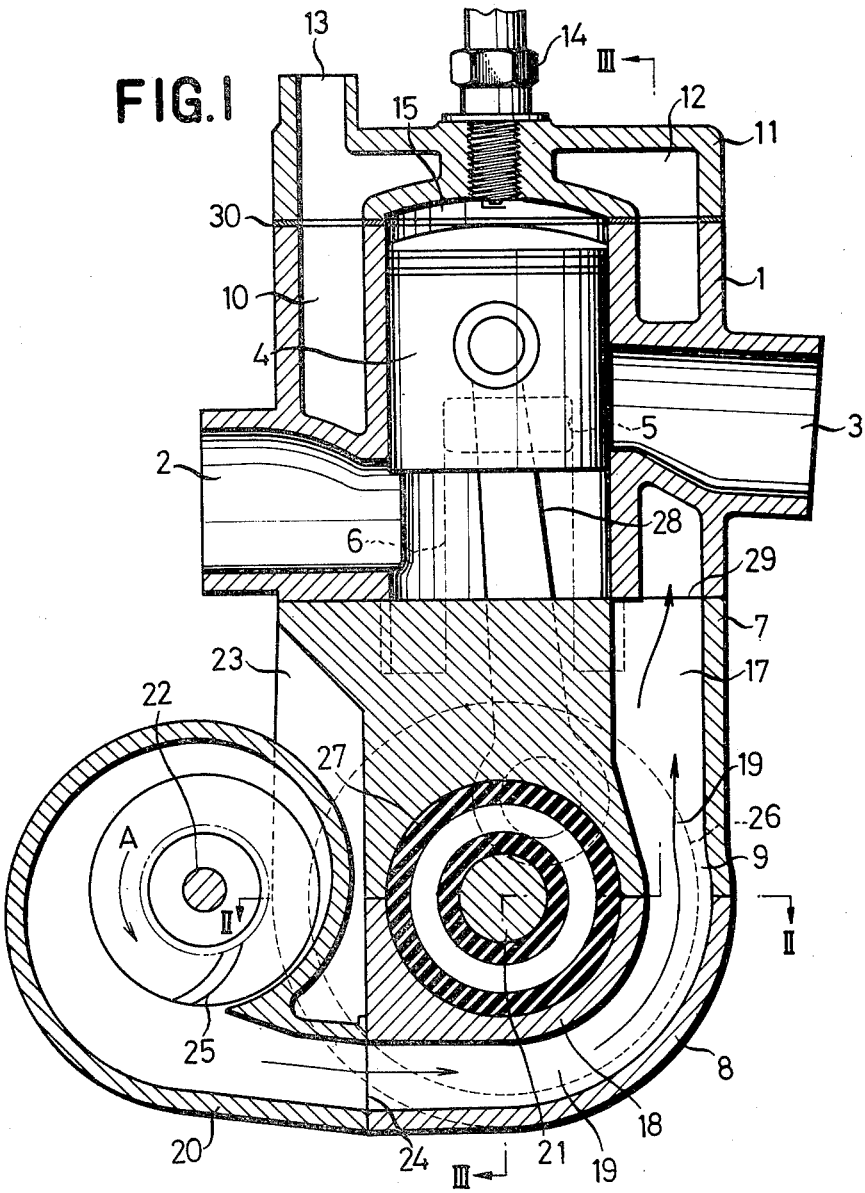
FIG. 1 is a sectional view of the cooling system according to the invention for a multicylinder engine taken along the line I—I in FIG. 3.

Though an engine in this embodiment has two cylinders only one of them is shown in FIG. 1, the second cylinder being identically constructed.

Referring to FIG. 1, cylinder 1 as here shown has connected to the left side thereof a suction conduit 2 and to the right side thereof an exhaust conduit 3. Fitted therein is a piston 4 for opening and closing a scavenging port 5, communicating through a scavenging passage 6 formed in an increased thickness portion of the cylinder 1, with a crank chamber 9 in an upper crank case member 7 and a lower crank case member 8. A liquid jacket 10 formed in a double wall of the cylinder 1 communicates with a liquid jacket 12 in a cylinder head 11 which has an outlet 13 connected to a radiator (not shown). 14 designates an ignition plug, and 15 a combustion chamber.

The portion of the liquid jacket 10 which surrounds the exhaust conduit 3 is connected to a first liquid jacket 17 located in the entire upper half of the upper crank case member 7. The flat liquid jacket communicates with an outlet of a liquid passage 19 at an upper end of the passage 19, which extends along the underside of a bearing housing 18 located between the crank chambers 9 associated with the respective cylinders 1 and the exhaust side of the crank case. (See FIGS. 2 and 3.)

A centrifugal liquid pump 20 has a shaft 22 parallel to a crank shaft 21 and supporting an impeller 25, and includes a pump casing arranged in a recess 23 formed on the suction side of the crank case in a position adjacent the bearing housing 18. The pump 20 is secured to the crank case in such a manner that a pump outlet 24 is substantially horizontal in a lower portion of the pump casing. An arrow A indicates the direction of rotation of the pump impeller 25. The pump outlet 24 communciates with an inlet of the liquid passage 19. 26 designates a crank web, 27 an airtight seal member between the crank chambers 9 (FIGS. 2 and 3), 28 a connecting rod, 29 a cylinder gasket, and 30 a head gasket. Solid arrows indicate the direction of flow of a cooling liquid.

Figure 2:
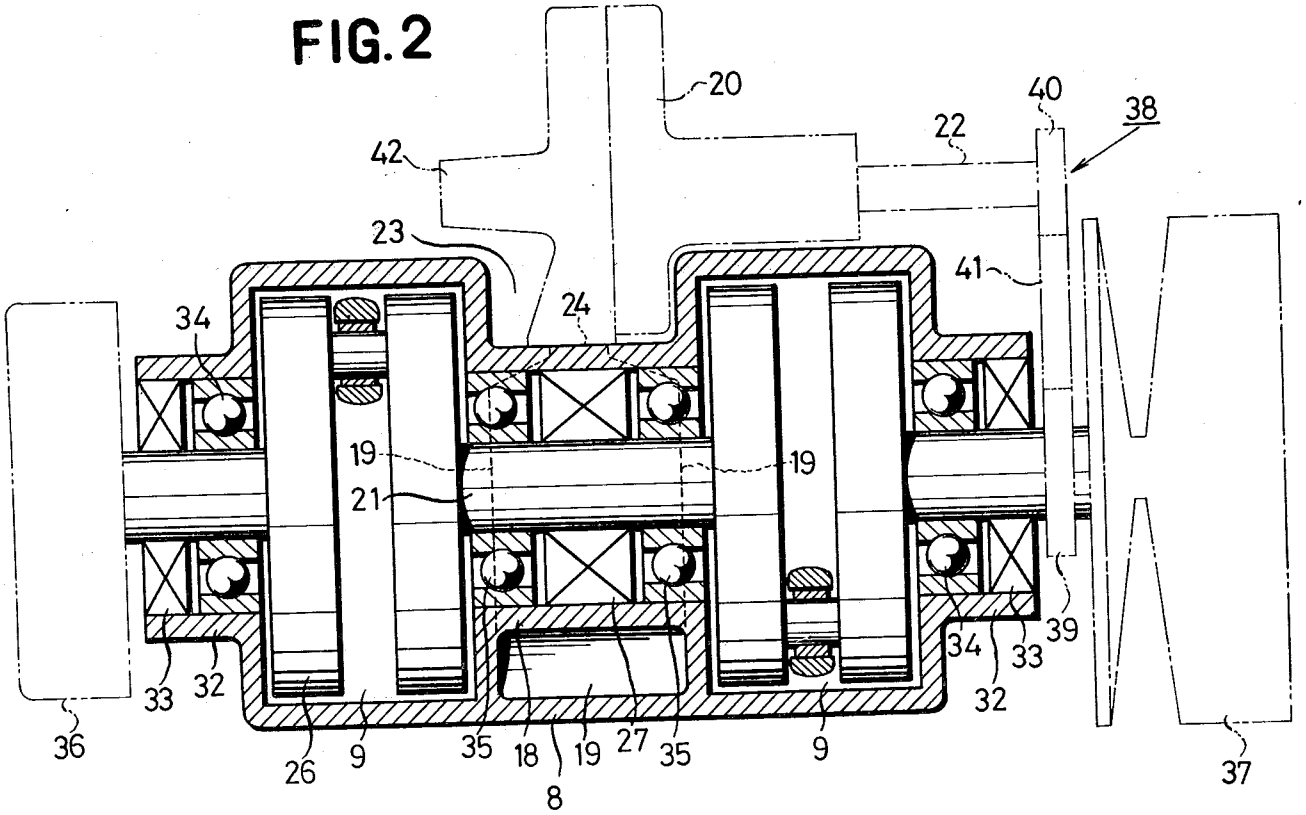
FIG. 2 is a sectional view taken along the line II—II in FIG. 1.

In FIG. 2, which is a sectional view taken along the line II—II in FIG. 1, airtight seal members 33 and 27, such as oil seal members, and bearings 34 and 35 are housed in bearing housings 32 and 18 at opposite end portions and at an intermediate portion of the crank case. The bearings 34 and 35 journal the crank shaft 21 for rotation. The crank shaft 21 has connected to one end thereof a flywheel 36 and to the other end thereof a belt converter 37, and is connected to the liquid pump shaft 22 through a drive 38 which consists, as shown, of a sprocket wheel 39 on the crank shaft 21, a sprocket wheel 40 on the pump shaft 22 and a chain 41 trained over the two sprocket wheels 39 and 40. It is to be understood that the drive 38 is not limited to the specific form shown and may consist of pulleys and a belt or gears. The pump 20 has an inlet 42 which is connected through a pipe (not shown) to the radiator (not shown).

As seen in FIG. 2, the portion of the crank case which constitutes the bearing housing 18 interposed between the crank chambers 9 is greatly reduced in diameter as compared with opposite end portions of the crank case which define the crank chambers 9 and forms a recess therein. The portion 23 of the recess which is disposed on the suction side of the crank case is used for arranging the pump casing of the pump 20 therein, and the portion of the recess disposed on the underside of the bearing housing 18 and on the exhaust side of the crank case is utilized to form the liquid passage 19 therein. By this arrangement, the pump shaft 22 is located in close proximity to the crank shaft 21 and the sideways bulging of the engine due to the presence of the liquid pump 20 is reduced. The crank case does not protrude from the exhaust side thereof at all, in spite of the fact that the liquid passage 19 is provided.

Figure 3:
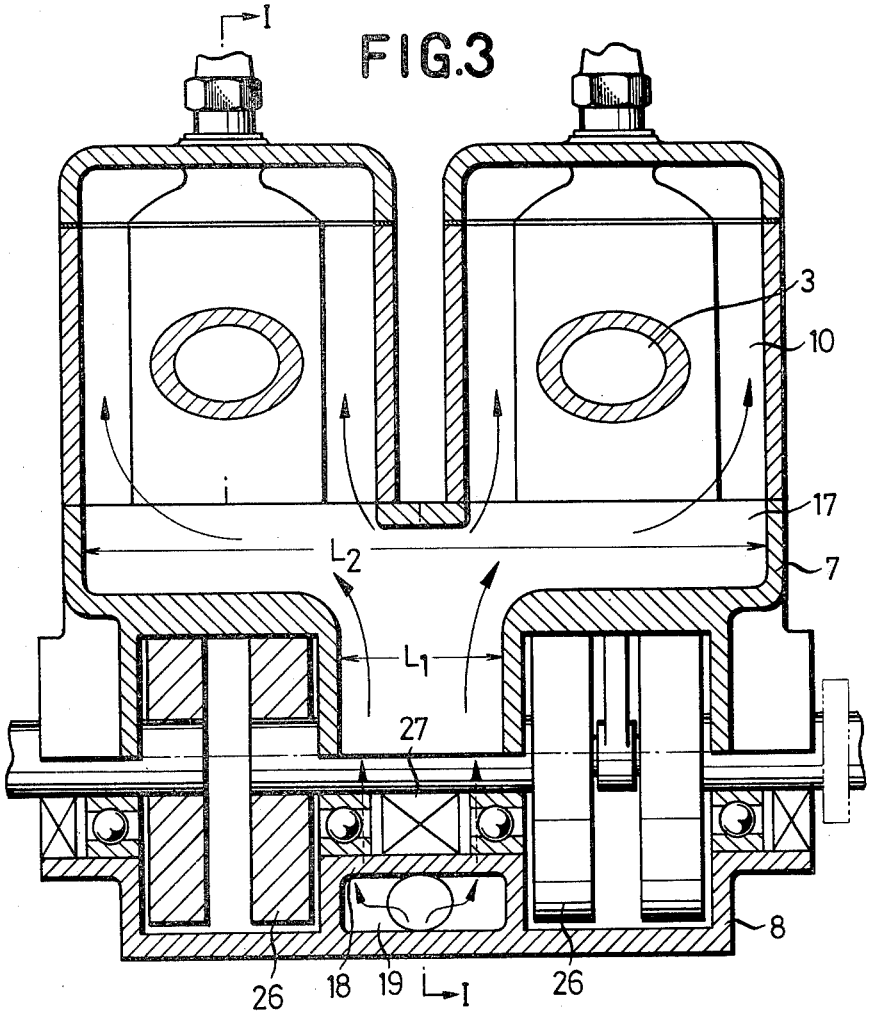
FIG. 3 is a sectional view taken along the line III—III in FIG. 1.

In FIG. 3, which is a sectional view taken on the line III—III in FIG. 1, the liquid passage 19 extending along the underside of the bearing housing 18 and the suction side of the crank case has a width $L_1$, equal to the width of the liquid passage in the lower crank case member 8, in a section thereof bordered on both sides by the crank webs 26 of the two cylinders (in a lower half portion of the upper crank case member 7), in its upward extension. The width of the liquid passage 19 is increased substantially to the same value ($L_2$) as the length of the crank case in an upper half portion of the upper crank case member 7, to form the flat liquid jacket 17. Thus the cooling liquid flowing upwardly through the liquid passage 19 of the width $L_1$ is diffused as indicated by solid arrows in the liquid jacket 17 of the width $L_2$, before being introduced into the liquid jacket 10 in the cylinders.

During operation of the engine, the liquid pump 20 is driven by the engine to release a cooling liquid through the pump outlet port 24 (FIG. 1) into the liquid passage 19. While flowing through the liquid passage 19, the cooling liquid cools the bearings 35 and seal members 27. The cooling liquid then flows from the liquid passage 19 into the liquid jacket 17, cooling the exhaust side of the upper crank case member 7. At the same time, the cooling liquid minimizes the amount of heat transmitted from the cylinders to the crank case. Thereafter, the cooling liquid flows from the liquid jacket 17 into the liquid jacket 10 in each of the cylinders disposed adjacent the exhaust conduits 3 from the interface between the cylinders 1 and the upper crank case member 7, to cool the exhaust conduits 3 of high temperature. The cooling liquid then cools the suction side of the cylinders 1 to cool same before being introduced into the liquid jacket 12 in the cylinder head of each cylinder 11 to cool the latter. The cooling liquid is finally released through the outlet of each cylinder 13 and forwarded to the radiator, where the cooling water itself is cooled and returned to an inlet 42 of the pump 20 (See FIG. 2).

The advantages of the aforesaid embodiment of this invention are listed in comparison with the disadvantages of the prior art, as follows:

1. The bearings arranged between the cylinders are much smaller in diameter than the crank webs, so that it is possible to form a recess 23 as shown in FIG. 2 on the side wall of the crank case between the crank chambers 9. By arranging the liquid pump 20 in the recess 23, it is possible to minimize the bulging of the pump from the side of the engine.

2. The liquid pump 20 is arranged on the suction side of the crank case between the cylinders. This arrangement enables the cooling system to be mounted on an engine having a flywheel (magneto) attached to one end of a crank shaft and a belt converter attached to the other end thereof and an engine having a suction rotary valve attached to either end of the crank case. The liquid passage extends from the lower crank case member to the upper crank case member between the crank chambers 9, changes its form into a flat passage in the upper crank case member, and communicates with the liquid jacket 10 in each of the cylinders disposed adjacent the exhaust conduits 3 at the interface between the cylinders and the upper crank case member. This construction permits the transfer of heat from the engines to the crank case to be inhibited satisfactorily, and can thus achieve increased efficiency in cooling the engine.

3. The liquid passage 19 extends along the underside of the airtight seal members 27 (oil seal members, for example) between the crank chambers 9 and the exhaust side of the crank case. This arrangement enables the exhaust side portion of the bearing housing 18, in which temperature tends to rise, to be cooled efficiently, thereby reducing a thermal load applied to the airtight seal members 27.

4. The liquid passage 19 extends along the underside of the bearings 35 and the exhaust side of the crank case. This arrangement is conducive to a decrease in the temperature in the bearing housing 18 as compared with the temperature in a bearing housing of an engine having a conventional cooling system. Thus, even if the crank case is formed of a light alloy in two members, there is no need to provide a large interference to the bearings 35 and the bearing housing 18 to prevent the production of a creep.

As aforesaid, the invention offers the advantage that effective cooling of the portions of the cylinders near the exhaust conduits and the airtight seal members and the bearings interposed between the crank chambers can be carried out. An added advantage is that the invention has particular utility in an engine having various instruments or parts attached to opposite ends of its crank shaft.

While the invention has been shown and described hereinabove by referring to a preferred embodiment thereof, it is to be understood that the invention is not limited to the specific form shown and described and that many changes and modifications may be made therein without departing from the scope of the invention. The invention can also have application in engines having more than two cylinders.

What is claimed is:

1. A liquid-cooled multicylinder engine comprising (A) at least one pair of adjacent cylinders in one portion of said engine, each cylinder having a suction conduit connected to one side thereof and an exhaust conduit connected to the other side thereof;

(B) a crank case connected to the cylinders, said crank case containing (1) a recess in its wall, (2) first liquid jacket means disposed on the same side of the crank case as the exhaust conduit, (3) a crank shaft which extends axially through the crank case, and (4) at least one bearing within said crank case substantially between said pair of cylinders for journalling said crank shaft, (C) second liquid jacket means connected to the first liquid jackt means, (D) a liquid pump in the recess of the crank case which is driven by said crank shaft and is connected to said first liquid jacket means by (1) a liquid passage means for circulating cooling liquid, said liquid passage means extending from the suction side to the exhaust side of said crank case along the underside and lateral side of the portion of the crank case containing said bearing, and (2) said liquid pump comprising a pump outlet connected to said liquid passage means on the suction side of said crank case.

2. A cooling system of the engine as set forth in claim 1, wherein said liquid pump is a centrifugal pump and includes a shaft mounting an impeller thereon and extending substantially parallel to said crank shaft.

3. A cooling system of the engine as set forth in claim 1, wherein said cooling system is adapted for use in a two cycle engine including cylinders each having a suction conduit connected to one side thereof and an exhaust conduit connected to the other side thereof, and said first liquid jacket means located in said crank case is disposed on the side of the crank case in which the exhaust conduits are disposed so as to cool the exhaust conduits efficiently.

4. A cooling system of the engine as set forth in claim 3, wherein the cooling liquid flowing from said first liquid jacket means to said second liquid jacket means cools the exhaust conduits and their vicinity, and then the cooling liquid spreads to the entire area of the second liquid jacket means for cooling the cylinders.

5. A cooling system of the engine as set forth in claim 1, wherein said crank case is composed of two crank case members attached to each other to provide the crank case.

6. A cooling system of the engine as set forth in claim 1, wherein at least one airtight seal member is mounted within said crank case.

* * * * *